US007155787B2

(12) United States Patent
Stündl

(10) Patent No.: US 7,155,787 B2
(45) Date of Patent: Jan. 2, 2007

(54) METHOD AND APPARATUS FOR STUFFER BOX CRIMPING A MULTIFILAMENT YARN

(75) Inventor: Mathias Stündl, Wedel (DE)

(73) Assignee: Saurer GmbH & Co. KG, Monchengladbach (DE)

( * ) Notice: Subject to any disclaimer, the term of this patent is extended or adjusted under 35 U.S.C. 154(b) by 63 days.

(21) Appl. No.: 11/109,014

(22) Filed: Apr. 19, 2005

(65) Prior Publication Data

US 2005/0246878 A1 Nov. 10, 2005

(30) Foreign Application Priority Data

May 6, 2004 (DE) ..... 10 2004 002 469

(51) Int. Cl.
*D02G 1/12* (2006.01)

(52) U.S. Cl. ..... 28/267; 28/263

(58) Field of Classification Search ..... 28/267, 28/263, 264–266, 255, 256, 257, 254, 221, 28/258, 271, 272, 274, 276
See application file for complete search history.

(56) References Cited

U.S. PATENT DOCUMENTS 3,751,778 A * 8/1973 Grosjean et al. ..... 28/267
3,802,038 A * 4/1974 Bauch et al. ..... 28/267
3,810,285 A * 5/1974 Ferrier et al. ..... 28/267
4,188,691 A * 2/1980 Matsumoto et al. ..... 28/267
4,268,940 A * 5/1981 Kuroda et al. ..... 28/255
4,956,901 A * 9/1990 Koskol et al. ..... 28/255
2004/0031134 A1* 2/2004 Koslowski et al. ..... 28/263
2004/0200048 A1* 10/2004 Hubner ..... 28/263
2004/0237211 A1 12/2004 Stundl

* cited by examiner

*Primary Examiner*—Amy B. Vanatta
(74) *Attorney, Agent, or Firm*—Alston & Bird LLP

(57) ABSTRACT

A method and an apparatus for stuffer box crimping a multifilament yarn, wherein the yarn being processed is pneumatically advanced by means of a conveying fluid into a stuffer box chamber and compacted to a yarn plug, with the conveying fluid leaving the stuffer box chamber through openings and being removed by suction. To be able to influence the yarn plug formation mainly by the suction stream, the invention provides for constructing the source of vacuum as an injector, which connects to a source of pressure via a pressure connection and to a suction line via a suction connection that precedes in the direction of the flow. As a result, the suction stream of the conveying fluid is generated by a compressed air stream, with the compressed air stream and the suction stream being jointly discharged as a common airflow.

16 Claims, 2 Drawing Sheets

METHOD AND APPARATUS FOR STUFFER BOX CRIMPING A MULTIFILAMENT YARN

BACKGROUND OF THE INVENTION

The present invention relates to a method and apparatus for stuffer box crimping a multifilament yarn, of the general type disclosed in WO 03/004743 A1.

For stuffer box crimping a preferably freshly spun, synthetic multifilament yarn, a feed nozzle pneumatically advances the yarn into a stuffer box chamber. To this end, the feed nozzle comprises a yarn channel, into which a conveying medium is introduced under a high pressure. Together with the conveying medium, the multifilament yarn advances from the yarn channel of the feed nozzle into a stuffer box chamber directly downstream thereof. Inside the stuffer box chamber, a yarn plug is formed, so that the action of the conveying medium causes the fine filaments of the yarn to collect in loops and coils on the surface of the yarn plug. Preferably in its upper region, the stuffer box chamber comprises a gas permeable wall, so that the conveying fluid is able to leave the stuffer box chamber for being removed by suction.

To obtain an as uniform plug formation as possible and thus a crimp of the yarn that is as even as possible, it is necessary that in particular the conveying forces acting upon the yarn plug, as they develop, for example, because of the impact pressure effect of the conveying medium leaving the yarn channel of the feed nozzle, and the frictional forces acting upon the yarn plug, be at a defined ratio to each other. Thus, it is known to raise the conveying pressure of the feed nozzle for increasing the conveying speed. However, in this connection one must make sure that the conveying pressure does not result in blowing the yarn plug out of the stuffer box chamber, because the frictional forces between the yarn plug and the stuffer box chamber wall are unable to produce adequate retaining forces.

Basically, there exist two possibilities of forming inside the stuffer box chamber an as uniform plug as possible. In a first variant, the formation and advance of the yarn plug inside the stuffer box chamber is largely determined by friction. In this case, the frictional forces acting between the yarn plug and the stuffer box chamber wall are decisive for building up retaining forces, so that a defined force ratio is active between the conveying pressure of the conveying fluid and the retaining forces, and that thus a uniform advance of the yarn plug prevails within the stuffer box chamber.

In a second variant, a pair of feed rolls is arranged directly at the outlet end of the stuffer box chamber. These paired feed rolls remove the yarn plug from the stuffer box chamber. Thus, the speed of the yarn plug and yarn plug formation is largely determined by the speed of the feed rolls.

In both cases, it is common to remove conveying fluid emerging from the stuffer box chamber by additional suction. To this end, it is common to connect a source of vacuum to an expansion chamber, which substantially surrounds the walls of the stuffer box chamber. By adjusting a defined suction effect, a further parameter exists to influence the plug formation within the stuffer box chamber. However, the use of this additional controlled variable gives rise to the problem that an intensive suction causes volatile components, such as, for example, residues of a yarn lubricant that adhere to the yarn, to be carried along and to cause contaminations. Furthermore, a precise and reproducible adjustability of the suction effect is needed to be able to perform fine adjustments for forming and advancing the plug.

It is therefore an object of the invention to further develop a method and an apparatus of the initially described type for stuffer box crimping a multifilament yarn such that the plug formation in the stuffer box chamber can be influenced by a suction stream of the conveying fluid in a precise and reproducible manner.

A further object of the invention is to provide a reliable and rapid removal of the suction stream from the stuffer box chamber.

SUMMARY OF THE INVENTION

The invention distinguishes itself in that for stuffer box crimping a multifilament yarn only a single source of energy suffices to be able to influence with the greatest possible flexibility both the advance of the yarn and the plug formation of the yarn. To this end, the suction stream of the conveying fluid is generated by a compressed air stream of an injector, with the compressed air stream and the suction stream being jointly discharged as an airflow. With that, it is becomes possible to advance to a central collection point with a high energy and without risk of contamination in particular volatile components that are contained in the suction stream of the conveying fluid.

The injector action has in addition the advantage that the suction effect is exclusively determined by the supplied compressed air stream. To this end, the injector comprises a compressed air connection, through which the compressed air stream can be supplied by means of a connected source of pressure. Thus, for example, one common source of compressed air could supply both the feed nozzle for generating a conveying stream and the injector for generating a suction stream.

In a preferred embodiment, the injector connects at its outlet end to a filter device, so that the airflow is filtered before entering the surrounding environment. Also, in practice, one may use heated compressed air as the conveying fluid, so that the conveying fluid can be discharged into the surroundings after expanding. In this connection, the use of a filtering device is especially advantageous for keeping away from the surroundings all foreign components, in particular residues of a yarn lubricant that are carried along in the suction stream.

To enable an adjustment of the suction stream, a regulating means is associated to the injector at its pressure connection, so that the supply of compressed air to the injector can be adjusted in quantity and/or pressure.

The method and the apparatus of the invention are thus particularly suited for the basic processes, wherein the yarn plug is exclusively influenced by friction inside the stuffer box chamber.

In the case that a driven pair of feed rolls is associated to the outlet end of the stuffer box chamber, it is possible to achieve a maximally possible flexibility in influencing the plug formation. In practical operation, however, a variant of the method has been found especially advantageous, wherein the plug formation initially occurs by an intensive suction stream at the beginning of the process. Upon expiration of a startup time, the supply of compressed air to the injector for generating the suction stream is adjusted to a minimum supply or totally shut down, so that the plug formation is exclusively influenced by the driven feed rolls at the outlet end of the stuffer box chamber. For carrying out this variant of the method, a regulating means may be associated with the injector and with a drive unit of the driven feed rolls. To this end, the regulating means of the injector and the drive unit of the feed rolls are connected to a controller.

In practice, it is common to arrange at the same time a plurality of feed nozzles and the stuffer box chambers in one mounting support. In this case, it is possible to discharge the conveying fluids of the individual stuffer box chambers advantageously by means of a common suction stream, so that the suction connection of the injector may advantageously be connected to a plurality of expansion chambers.

BRIEF DESCRIPTION OF THE DRAWINGS

In the following, the method and the apparatus of the invention are described in greater detail by means of several embodiments and with reference to the attached Figures, in which.

DETAILED DESCRIPTION OF THE PREFERRED EMBODIMENTS

Figure 1:
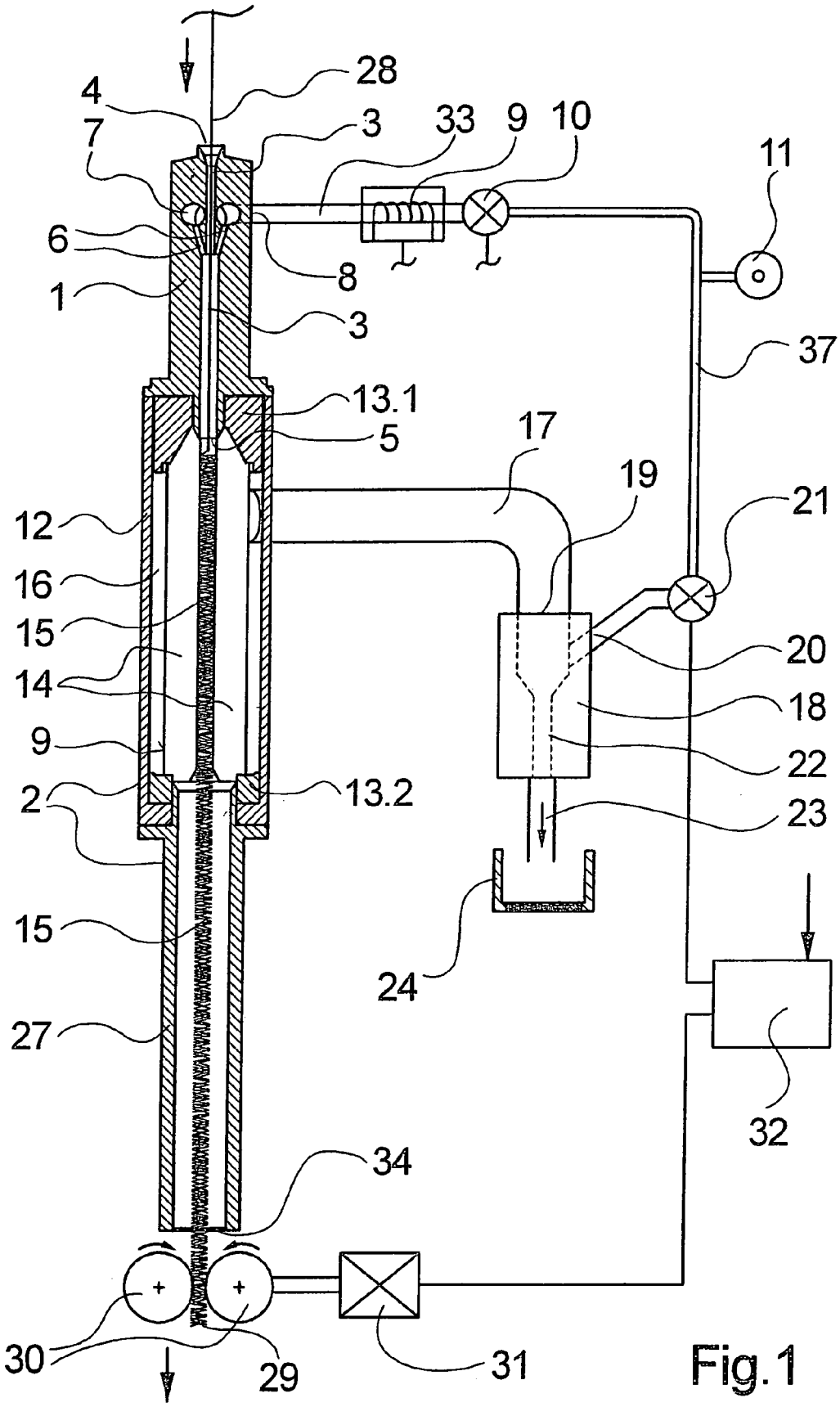
FIG. 1 is a schematic, longitudinally sectioned view of a first embodiment of the apparatus according to the invention for carrying out the method of the invention.

FIG. 1 schematically illustrates a longitudinally sectioned view of a first embodiment of the apparatus according to the invention for carrying out the method of the invention. The apparatus comprises a feed nozzle 1 and a crimping device 2 downstream thereof. The feed nozzle 1 includes a yarn channel 3, which forms at its one end an inlet 4 and at its opposite end an outlet 5. The feed nozzle 1 connects via a fluid inlet 8 to a source of pressure 11. The fluid inlet 8 ends in a pressure chamber 7, which connects via a plurality of air inlet passageways 6 to the yarn channel 3. The air inlet passageways 6 terminate in the yarn channel 3 such that a conveying medium entering via the pressure chamber 7 through the air inlet passageways 6 flows into the yarn channel in the direction of the advancing yarn.

A supply line 33 arranged at the fluid inlet 8 is associated to a heating device 9 for heating the conveying fluid, as well as to a fluid regulating means 10 for regulating the conveying pressure and conveying quantity.

Arranged directly downstream of the feed nozzle 1 is a crimping device 2. The crimping device 2 forms a stuffer box chamber 15, which comprises an upper section with a gas permeable wall 14 and a lower section with a closed chamber wall 27. In the present embodiment, the gas permeable chamber wall 14 is formed by a plurality of lamellae arranged in side-by-side relationship, which annularly extend at a small distance from one another. The lamellae of the gas permeable chamber 14 are held in an upper lamella holder 13.1 and in a lower lamella holder 13.2. Both the chamber wall 14 and the holders 13.1 and 13.2 are arranged in a closed casing 12. An annular space formed by the casing 12 outside of the gas permeable wall 14 forms an expansion chamber 16. The expansion chamber 16 connects to a suction line 17. The suction line 17 connects outside of the crimping device 2 to a suction connection 19 of an injector 18. The injector 18 includes a pressure connection 20, to which a regulating means 21 is associated. The pressure connection 20 connects via the regulating means 21 to the source of pressure 11.

Inside the injector 18, the suction lines 17 and the pressure connection 20 terminate in an acceleration zone 22 that is formed by a cross sectional contraction. The acceleration zone 22 connects to an airflow duct 23 and forms the outlet of the injector 18. The airflow duct 23 ends in a filter device 24.

The underside of the crimping device 2 includes a plug outlet 34 of the stuffer box chamber 15. At a short distance downstream of the plug outlet 34, a feed means 30 is arranged, which is formed in the present embodiment by two opposite rolls. The feed rolls are driven in opposite directions via a drive unit 31.

The feed nozzle 1 and the crimping device 2 are controlled by a controller 32. To this end, the controller 32 connects via a plurality of control lines to the fluid regulating means 10, the suction regulating means 21, the heating device 9, and the drive unit 31.

In the embodiment of the apparatus according to the invention for carrying out the method of the invention as shown in FIG. 1, a yarn path is shown for better illustrating the operation of the apparatus. In the apparatus, a conveying fluid made available by the source of pressure 11 is supplied to the feed nozzle 1 in a first step. The fluid regulating means 10 permits adjusting preferably a conveying pressure, under which the conveying medium is supplied to the fluid inlet 8 via supply line 33. Before that, the conveying fluid is heated by the heating device 9. From the fluid inlet 8, the conveying fluid enters the pressure chamber 7, and flows at a high velocity through the air inlet passageways 6 into the yarn channel 3. The conveying fluid entrains a yarn 28 that has been inserted into the yarn channel 3, and advances it into the adjacent stuffer box chamber 15 of the crimping device 2. Inside the stuffer box chamber 15, a yarn plug 29 is formed, so that that when impacting upon the yarn plug 29, the yarn formed by a plurality of fine filaments collects in coils and loops on the surface of the yarn plug and compacts under the impact pressure of the conveying medium.

The impact pressure acting upon the yarn plug 29 is increased by a vacuum, which the injector 18 generates in the expansion chamber 16. To this end, the injector receives from the source of pressure 11, via the suction regulating means 21, a second fluid stream, which is supplied to the injector 18 via the pressure connection 20. The resultant vacuum forming at the suction connection 19 of the injector 18 generates a suction stream that is discharged from the expansion chamber 16 via the suction line 17. At the outlet end of the injector 18, the suction stream and the compressed air stream are jointly supplied via the airflow duct 23 to the filter device 24. In the filter device 24, the suction stream is freed from entrained and carried along foreign particles, which largely result from volatile components of the yarn 28. The injector 18 determines on the one hand the impact pressure of the conveying medium, which influences the formation of the yarn plug, and ensures on the other hand a fast and contamination free discharge of the suction stream from the crimping device 2.

At the outlet end of the crimping device 2, the feed means 30 continuously removes the yarn plug 29 from the stuffer box chamber 15. In this process, the speed of the yarn plug 29 is adjusted such that the height of the yarn plug 29 inside the stuffer box chamber 15 remains substantially unchanged.

Normally, after cooling, the yarn plug is disentangled by withdrawing the yarn at a higher speed. The crimped yarn forming in this process is subsequently wound to a package after possibly undergoing an aftertreatment.

With the use of the embodiment shown in FIG. 1, a variant of the method for crimping a yarn has been found especially advantageous, wherein at the beginning of a process a high vacuum is adjusted in the expansion chamber 16 by the injector 18. In so doing, great retaining forces form on the yarn or the yarn plug over the entire length of the gas permeable wall 14. A yarn advancing through the yarn channel 3 into the stuffer box chamber 5 automatically forms a yarn plug. After the formation of the yarn plug is completed, the injector action is reduced or stopped via the suction regulating means 21. The formation of the yarn plug 29 within the stuffer box chamber 15 can then be largely controlled by the feed means 30 at the outlet end of the crimping device 2.

It is accordingly possible to intervene in the plug formation by changing the conveying pressure of the feed nozzle 1 via the fluid regulating means 10, by the vacuum for the suction via the suction regulating means 21, or by varying the circumferential speed of the feed means 30 via the drive unit 31.

Figure 2:
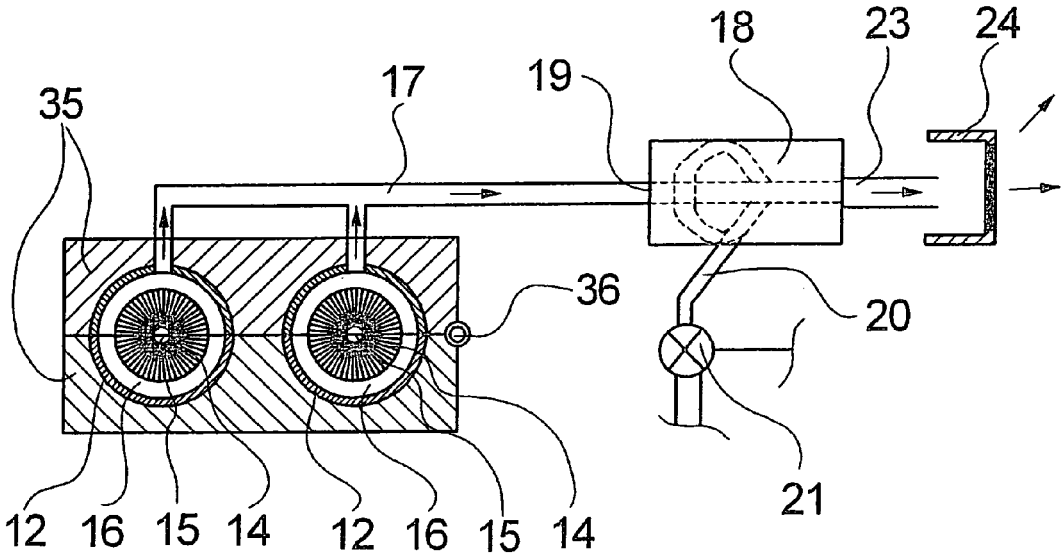
FIG. 2 is a schematic cross sectional view of a further embodiment of the apparatus according to the invention.

FIG. 2 schematically illustrates a cross sectional view of a further embodiment of the apparatus according to the invention for carrying out the method of the invention. The embodiment comprises two crimping devices 2 arranged in parallel and side-by-side relationship in a mounting support 35. The crimping devices 2 and the mounting support 35 are made bipartite and can be jointly moved relative to one another about a pivot axle 36. The crimping device 2 is shown at the height of the gas permeable wall 14. Located in the center of the crimping device 2 is the stuffer box chamber 15. The stuffer box chamber 15 connects via openings in the gas permeable wall 14 to an expansion chamber 16 surrounding the gas permeable wall 14. The expansion chamber 16 of each of the crimping devices 2 connects to a suction line 17. The suction line 17 connects with an opposite end to a suction connection 19 of an injector 18. The injector 18 comprises a pressure connection 20, which is formed in the present embodiment by a plurality of inlet channels. Associated to the pressure connection 20 is a suction regulating means 21. An airflow duct 23 connects the injector 18 to a filter device 24.

In the embodiment shown in FIG. 2, the crimping devices are constructed identical with the foregoing embodiment of FIG. 1, so that the foregoing description may herewith be incorporated by reference. Unlike the foregoing embodiment of FIG. 1, in the embodiment of FIG. 2 two feed nozzles and crimping devices arranged parallel in side-by-side relationship are operated in parallel, so as to crimp two parallel advancing yarns at the same time. In this case, it is possible and advantageous to arrange also more than two crimping devices in side-by-side relationship on a common mounting support.

To generate a suction stream, each of the crimping devices connects to a common suction line 17. The suction line 17 connects to the injector 18, so that a vacuum generated by the injector is operative in the same way in the two expansion chambers of the crimping devices 2. The function for building up the vacuum as well as for discharging the suction stream is identical with the foregoing embodiment of FIG. 1, so that the foregoing description may herewith be incorporated by reference.

The method and the apparatus of the invention are thus especially suited for influencing a plug formation with the greatest possible flexibility. With that, it is possible to treat yarns of a relatively large denier range. The great flexibility thus permits producing individual crimps depending on the type and quality of the yarn. The use of an injector for removing the conveying medium by suction provides a process reliable and excellently reproducible adjustability, which additionally permits discharging the suction stream in a safe way.

The invention claimed is:

1. A method for stuffer box crimping a multifilament yarn, comprising the steps of pneumatically advancing the multifilament yarn into a stuffer box chamber by means of a conveying fluid, so as to compact the yarn and form a yarn plug which is advanced within the stuffer box chamber, and while causing the conveying fluid to emerge from the stuffer box chamber through openings and be removed by a suction stream, and wherein the suction stream is generated by a compressed air stream in an injector, with the compressed air stream and the suction stream being jointly discharged as an airflow.

2. The method of claim 1, wherein the discharged airflow is filtered before entering the surrounding environment.

3. The method of claim 1, wherein the compressed air stream which generates the suction stream is supplied at a variable overpressure for influencing the suction stream.

4. The method of claim 1, wherein the compressed air stream which generates the suction stream is generated only for a short period at the beginning of the process.

5. The method of claim 1, wherein the compressed air stream which generates the suction stream is reduced or shut down a short time after the beginning of the process, and wherein after reducing or shutting down the compressed air stream the yarn plug is removed from the stuffer box chamber by an additional feed means.

6. The method of claim 5, wherein the additional feed means comprises a pair of oppositely driven feed rolls which are positioned to withdraw the yarn plug from the stuffer box chamber.

7. The method of claim 1, wherein the conveying fluid which advances the yarn into the stuffer box, and the compressed air stream in the injector, are supplied from a common source of compressed air.

8. An apparatus for stuffer box crimping a multifilament yarn, comprising a feed nozzle for pneumatically advancing a multifilament yarn, a stuffer box chamber positioned downstream of the feed nozzle for receiving the yarn and forming a yarn plug, said stuffer box chamber having a gas permeable region surrounded by an expansion chamber, with the expansion chamber being connected via a suction line to a source of vacuum, and wherein the source of vacuum comprises an injector which is connected to a source of pressure via a pressure connection and to the suction line via a suction connection, so that the source of pressure generates a vacuum in the suction line.

9. The apparatus of claim 8, wherein the injector connects at its outlet end to a filter device.

10. The apparatus of claim 8, wherein the injector includes an acceleration zone in which the pressure connection and the suction connection terminate.

11. The apparatus of claim 8, further comprising a regulating means associated to the pressure connection of the injector, which permits adjusting the supply of compressed air in quantity and/or pressure.

12. The apparatus of claim 11, further comprising a feed means in the form of a pair of feed rolls associated to the stuffer box chamber, with the pair of feed rolls being driven by a drive unit for removing the yarn plug from the stuffer box chamber.

13. The apparatus of claim 12, wherein the regulating means of the injector and the drive unit of the paired feed rolls connect to a controller.

14. An apparatus for stuffer box crimping a plurality of multifilament yarns, comprising a support mounting a plurality of stuffer box crimping devices in a parallel, side-by-side arrangement, with each stuffer box crimping device comprising (a) a feed nozzle for pneumatically advancing a multifilament yarn, and (b) a stuffer box chamber positioned downstream of the feed nozzle for receiving the yarn and forming a yarn plug, said stuffer box chamber having a gas permeable region surrounded by an expansion chamber, with the expansion chamber being connected to a suction line, and wherein the suction lines of the crimping devices lead to a common source of vacuum which comprises an injector which is connected to a source of pressure via a pressure connection and to each of the suction lines via a suction connection, and so that the source of pressure generates a vacuum in each of the suction lines.

15. The apparatus of claim 14 further comprising a regulator connected to the pressure connection of the injector for adjusting the supply of the compressed air and thereby adjusting the vacuum level in the suction lines.

16. The apparatus of claim 15 wherein each of the crimping devices further comprises a pair of controlled feed rolls positioned for removing the yarn plug from the associated stuffer box chamber.

* * * * *